United States Patent [19]

Ingersoll

[11] 3,968,708

[45] July 13, 1976

[54] ADJUSTABLE WRENCH

[75] Inventor: Charles B. Ingersoll, Orchard Park, N.Y.

[73] Assignee: TRW Inc., Cleveland, Ohio

[22] Filed: Nov. 25, 1974

[21] Appl. No.: 526,904

[52] U.S. Cl. ..... 81/157

[51] Int. Cl.[2] ..... B25B 13/16

[58] Field of Search ..... 81/157, 165, 166, 170

[56] References Cited

UNITED STATES PATENTS

| | | | |
|---|---|---|---|
| 1,431,451 | 10/1922 | Armstrong | 81/165 X |
| 2,499,644 | 3/1950 | Heyn | 81/157 |
| 3,857,308 | 12/1974 | Lindgren | 81/157 |

FOREIGN PATENTS OR APPLICATIONS

| | | | |
|---|---|---|---|
| 409,652 | 4/1910 | France | 81/165 |

*Primary Examiner*—Al Lawrence Smith
*Assistant Examiner*—James G. Smith

[57] ABSTRACT

An improved adjustable wrench includes a worm gear which is releasably held in a gear cavity in the frame of the wrench by a retaining assembly. The retaining assembly includes a pair of pin or plunger members. During normal use of the wrench, the plunger members project outwardly from opposite ends of an axially extending cavity in the worm gear to support the worm gear for rotation about its central axis. When the wrench is to be disassembled, one of the plunger members is pressed into the cavity in the worm gear and the other plunger member is pressed into a cavity in the frame of the wrench. The worm gear can then be moved sidewardly out of the gear cavity. When the wrench is to be reassembled, one of the plungers is telescoped back into the cavity in the worm gear while the other plunger is pressed into the cavity in the frame of the wrench. The worm gear is then inserted into the gear cavity and the plungers are released.

16 Claims, 7 Drawing Figures

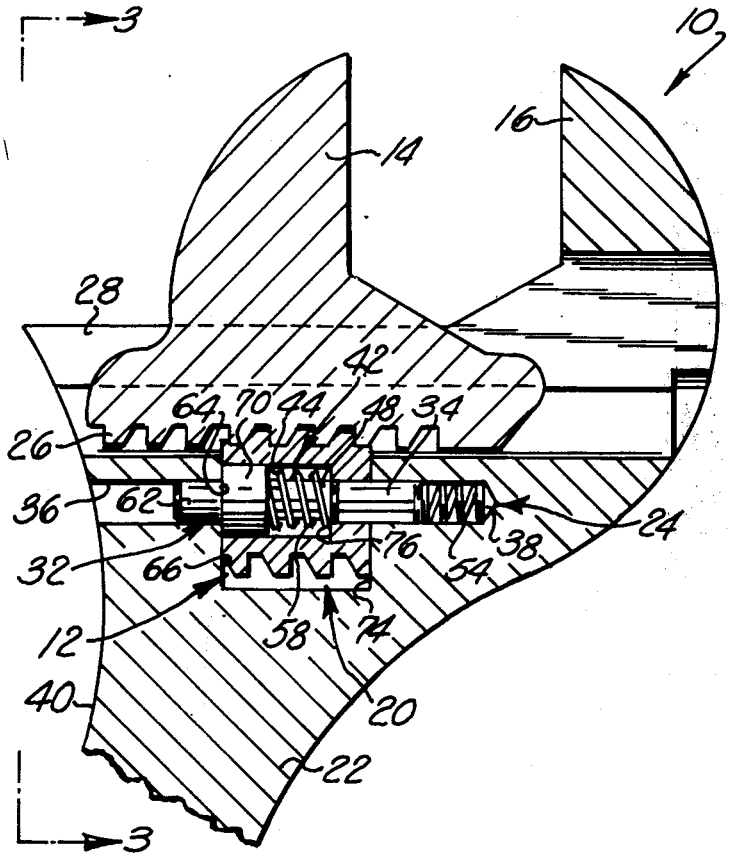

ADJUSTABLE WRENCH

BACKGROUND OF THE INVENTION

The present invention relates to an improved wrench and more specifically to a wrench having an improved retaining assembly for releasably mounting a worm gear on the frame of the wrench.

A known adjustable open end wrench includes a worm gear which turns on a shaft or pin that is threaded on one end. The shaft is secured into a mating thread in the head of a wrench handle and locked in position by a staking operation. This known wrench includes a coil spring which is utilized to reduce end play between the worm gear and the slot or cavity in the wrench handle.

With this known wrench, the required thread tolerances between the tapped hole in the wrench handle and the threaded shaft are critical and troublesome. Tap breakage and resulting machine down time is expensive. Coil spring interferences between the shaft, the drilled hole and the counterbore in the worm gear also contribute to the cost of manufacturing the wrench. In addition, screwing the shaft into its position in the wrench handle is slow and occasional disassembly requirements are burdensome.

Another known wrench is disclosed in U.S. Pat. No. 1,431,451. This wrench utilizes a pair of pins to mount a worm gear in a gear cavity in the wrench handle. One of the pins is disposed in a hole in a cavity in the frame of the wrench. The outer end of this pin is received in a bore in the worm gear. The pin has a larger external diameter than the bore in the worm gear and cannot be telescoped into the bore of the worm gear. A second pin, which also has a larger outside diameter than the bore in the worm gear, presses the worm gear against the first pin under the influence of a biasing spring. When the jaws of the wrench disclosed in this patent are in an open position, the worm gear can be moved axially toward the fixed jaw against the influence of the biasing spring and could result in accidental or inadvertent disassembly of the wrench. Other adjustable wrench constructions are disclosed in U.S. Pat. Nos. 1,747,360; 3,580,115 and 3,673,896.

SUMMARY OF THE PRESENT INVENTION

The present invention relates to an adjustable wrench which utilizes a worm gear to effect movement of a jaw of the wrench. In accordance with a feature of the present invention, an improved retaining assembly is provided to releasably retain the worm gear in a gear cavity in the frame of the wrench. This retaining assembly includes a member, such as a plunger or pin, which is movable between an engaged position extending outwardly from a cavity in the worm gear into engagement with the frame of the wrench and a released position in which the retaining member is disposed substantially entirely within the cavity in the worm gear. When the retaining member is disposed within the cavity in the worm gear, the worm gear is at least partially released for movement out of the gear cavity in the frame of the wrench.

In one specific preferred embodiment of the invention, the retaining assembly includes two pin type retaining members which are telescopically received within a bore or cavity formed in the worm gear. The two pin members extend outwardly from opposite end portions of the worm gear into engagement with the frame of the wrench to hold the worm gear in the gear cavity. When the wrench is to be disassembled, one of the pins is telescoped substantially entirely into the cavity in the worm gear and the other pin is moved out of the cavity in the worm gear. This releases the worm gear so that it can move sideways out of the gear cavity in the frame of the wrench.

Accordingly, it is an object of this invention to provide a new and improved wrench wherein a worm gear is releasably mounted on the frame of the wrench by means of a retaining member which can be moved into a cavity formed in the worm gear to release the worm gear and thereby facilitate disassembly of the wrench.

Another object of this invention is to provide a new and improved wrench in which a worm gear is held in a cavity in the frame of the wrench by an improved retaining assembly which includes first and second members which are movable to a released condition in which one of the two members is disposed substantially entirely within a cavity in the worm gear and the second member is disposed entirely outside of the worm gear.

BRIEF DESCRIPTION OF THE DRAWINGS

The foregoing and other objects and features of the present invention will become more apparent upon consideration of the following description taken in connection with the accompanying drawings wherein.

DESCRIPTION OF SPECIFIC PREFERRED EMBODIMENTS OF THE INVENTION

Figure 1:
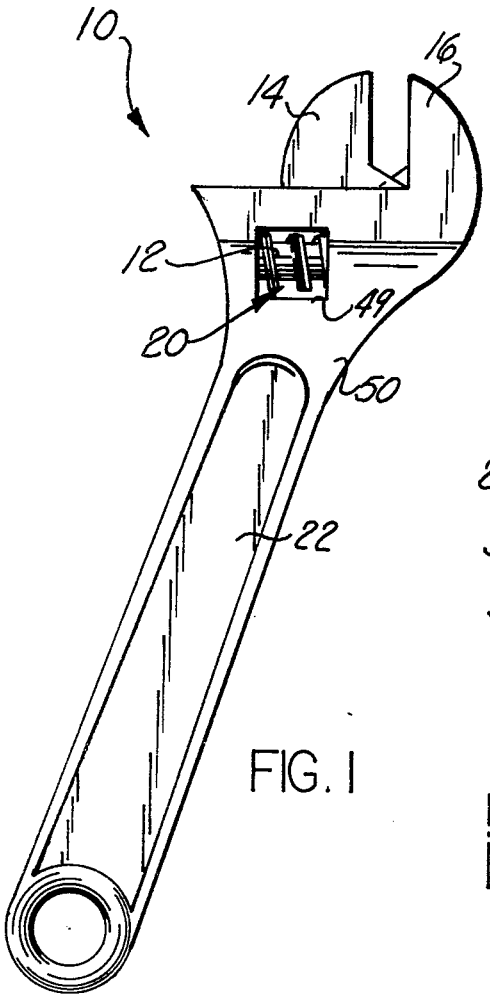
FIG. 1 is an illustration of an adjustable, open end wrench constructed in accordance with the present invention.

An adjustable, open end wrench 10 constructed in accordance with the present invention, includes a worm gear 12 which is rotatable to move a jaw 14 toward or away from a fixed jaw 16 of the wrench. The worm gear 12 is rotatably mounted in a generally rectangular gear cavity or slot 20 formed in a frame 22 of the wrench 10 by an improved retaining assembly 24 (see FIG. 2). The worm gear 12 is disposed in meshing engagement with a rack gear 26 which is integrally formed with the movable jaw 14.

Figure 3:
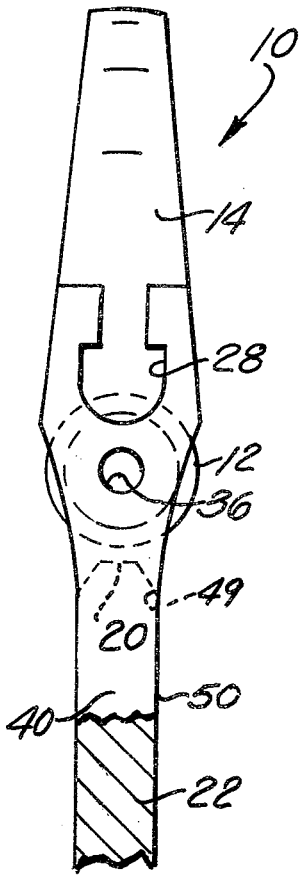
FIG. 3 is an elevational view, taken generally along along the line 3—3 of FIG. 2, further illustrating the relationship of the worm gear to the frame and movable jaw of the wrench.

When the worm gear 12 is rotated in one direction, for example, clockwise as viewed in FIG. 3, the helical teeth of the worm gear 12 interact with the rack gear 26 to effect movement of the jaw 14 toward the fixed jaw 16. Similarly, rotation of the worm gear 12 in a counterclockwise direction (as viewed in FIG. 3) moves the jaw 14 away from the fixed jaw 16. The jaw 14 is slidably supported in known manner by a guideway 28 in the frame 22 of the wrench 10.

In accordance with a feature of the present invention, the retaining assembly 24 is releasable to enable the worm gear 12 to be moved out of the gear cavity 20 to facilitate disassembly of the wrench 10. The retaining assembly 24 includes a pair of coaxial plungers or pin members 32 and 34 which support the worm gear 12 for rotation about its central axis. The pins 32 and 34 extend axially outwardly from opposite ends of the worm gear 12 into engagement with pin cavity or recesses 36 and 38 formed in the frame member 22. The pin cavities 36 and 38 are part of a single cylindrical bore or passage which extends inwardly from a minor side surface 40 of the frame 22 through the gear cavity 20. The pins 32 and 34 have a circular cross sectional configuration so as to support the worm gear 12 for rotation about its central longitudinal axis which is coincident with the central axes of the pin members 32 and 34 and the central axes of the cavities 36 and 38.

When the wrench 10 is to be disassembled, an actuator rod 41 (FIG. 4) is inserted into the cavity 36 and pressed against a circular end of the pin member 32. This forces the pin 32 axially into a bore or cavity 42 formed in the worm gear 12. As the pin or retaining member 32 is telescoped into a relatively large diameter main section 44 of the bore 42, a cylindrical end portion 48 of the plunger 32 forces the pin 34 out of the bore or cavity 42 in the worm gear 12 into the pin cavity 38 in the frame 22.

Once the pin 32 has been telescoped entirely into the internal cavity 42 of the worm gear 12 and the cylindrical pin 34 has been telescoped into the cavity 28 in the frame 22, the worm gear 12 is free to move sidewardly out of the gear cavity 20. The application of a rightwardly directed force (as viewed in FIG. 3) against one side of the worm gear 12 will then cause the worm gear 12 to move through a rectangular opening 49 in a major side surface 50 of the frame 22.

Once the worm gear 12 has been moved out of the gear cavity 20, the retaining member or pin 34 is free to move axially out of the cylindrical pin cavity 38 under the influence of a coil spring 54. In addition, when the rightward force is removed from the end of the pin member 32, it is moved axially toward the left under the influence of a second coil spring 58 disposed in the worm gear bore 42. Of course, once the worm gear 12 has been removed from the gear cavity 20, the movable jaw 14 can be freely slid along the guideway 28 to fully disassemble the wrench.

Figure 2:
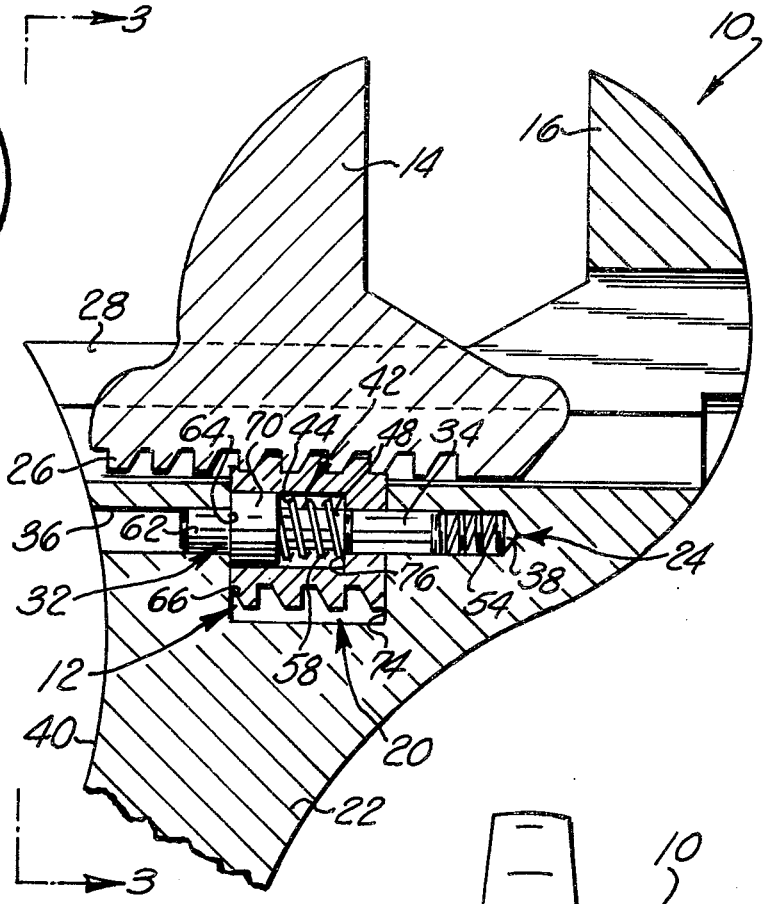
FIG. 2 is an enlarged fragmentary sectional view illustrating the relationship between fixed and movable jaws of the wrench, a worm gear for effecting movement of a jaw of the wrench, and a retaining assembly for releasably mounting the worm gear on the frame of the wrench.

When the wrench 10 is to be reassembled, the movable jaw 14 is reinserted into the guideway 28 in a position similar to the one shown in FIG. 2. The worm gear 12 is then positioned with its threads in engagement with the rack gear 26 on the movable jaw 14. Since at this time the pin 34 extends axially out of the frame cavity 38 under the influence of the biasing spring 54 and the pin 32 extends axially out of the worm gear cavity 32 under the influence of the biasing spring 58, the two pins interfere with movement of the worm gear 12 into the gear cavity 20. Therefore, the pin 34 is depressed against the influence of the biasing spring 54 and the pin 32 is retracted into the worm gear bore 42 against the influence of the biasing spring 58 (see FIG. 4). The worm gear is then moved sidewardly into the gear cavity 20.

Figure 4:
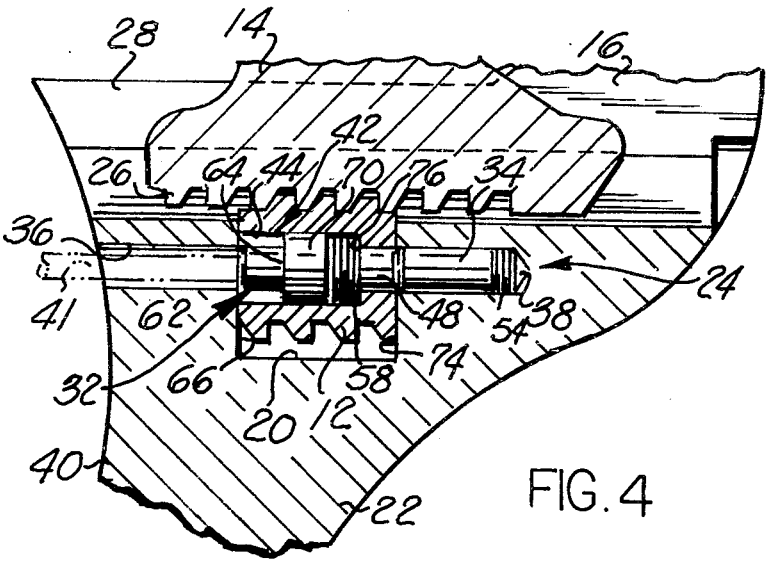
FIG. 4 is a fragmentary sectional view illustrating the worm gear retaining assembly in a released condition.

When the two pins 32 and 34 have moved into axial alignment, the biasing spring 54 causes the pin 34 to move axially outwardly from the position shown in FIG. 4 to the position shown in FIG. 2. As this is occurring, the pin 32 is moved axially out of the bore 42 so that a cylindrical end portion 62 of the pin is received in the cylindrical pin cavity 36. The biasing spring 38 is then effective to apply a force against the pin member 34 to press an annular shoulder 64 on the pin member 32 against a sidewall 66 of the gear cavity 20. When the two pin members 32 and 34 move to the engaged position shown in FIG. 2, the worm gear 12 is supported for rotation on a cylindrical outer surface of a large diameter body portion 70 of the pin member 32 and on a cylindrical outer surface of the pin member 34. It should be noted that the worm gear 12 is pressed against the sidewall 74 of the gear cavity 20 by the spring 58 which is disposed between the cylindrical body portion 70 of the pin member 32 and an annular shoulder 76 formed in the worm gear bore 42.

When the wrench 10 is in the assembled position of FIG. 2, the retaining assembly 24 firmly holds the worm gear 12 against movement out of the gear cavity 20. Thus, the abutting engagement between the cylindrical surfaces of the pin members 32 and 34 and frame cavities 36 and 38 prevents the worm gear 12 from being moved sideways relative to the frame 22. The biasing spring 54 maintains the pin member 34 in the position shown in FIG. 2 so that the pin member 32 is not accidentally forced out of the cavity 36 under the influence of normal operating forces. Although pin type retaining members 32 and 34 having cylindrical outer surfaces have been illustrated in the drawings, it is contemplated that other types of retaining members could be utilized if desired.

Figure 5:
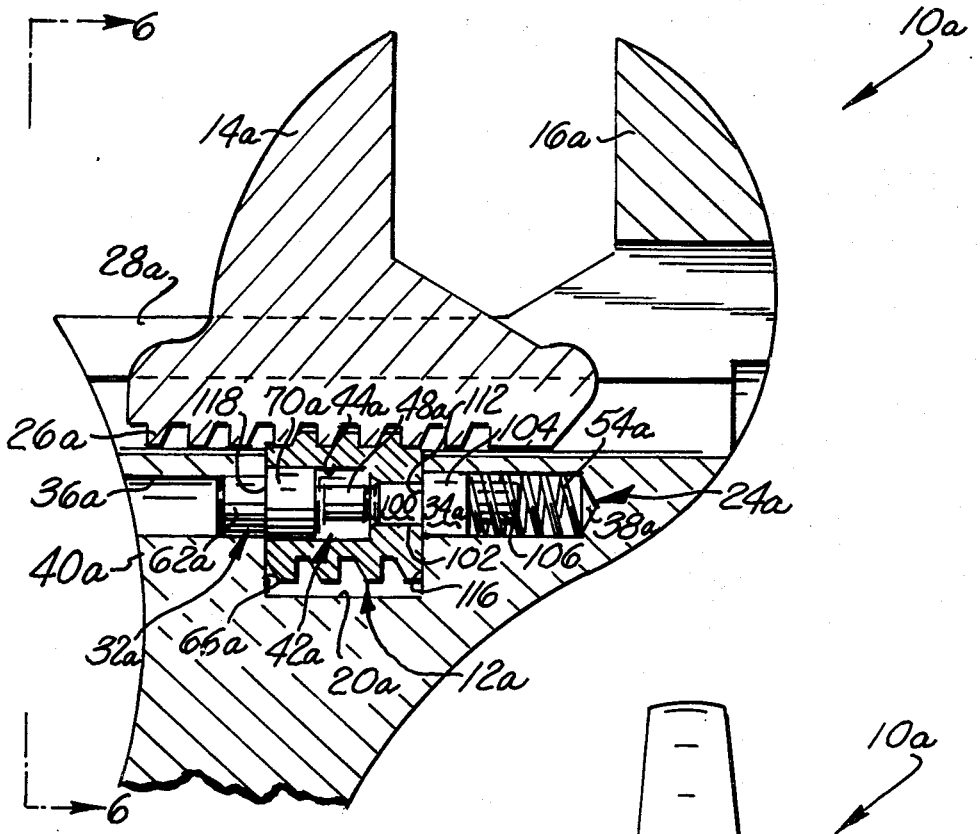
FIG. 5 is a fragmentary sectional view, similar to FIG. 2, illustrating a second embodiment of the invention.
Figure 6:
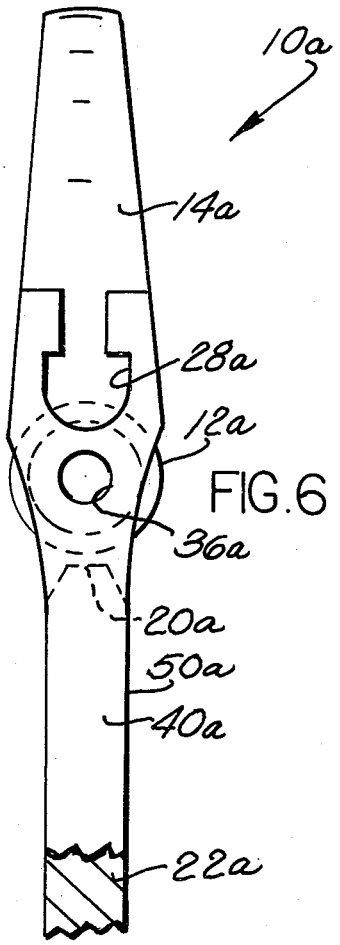
FIG. 6 is an elevational view, taken generally along the line 6—6 of FIG. 5, further illustrating the construction of the second embodiment of the invention.
Figure 7:
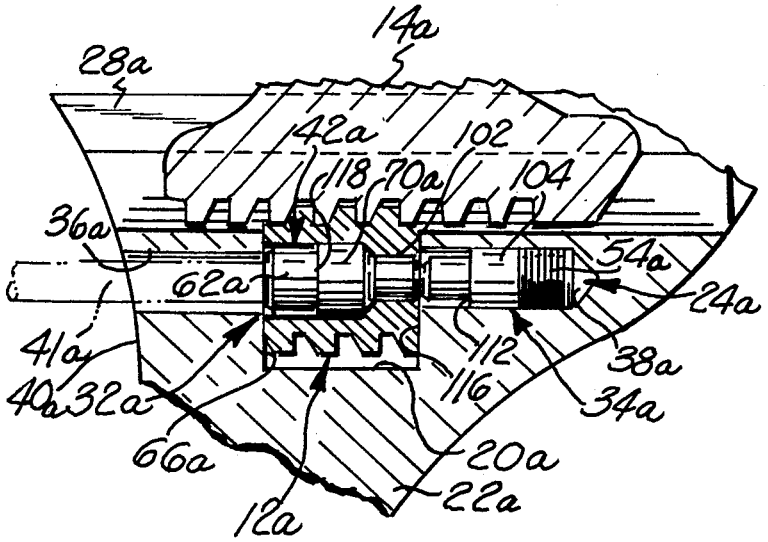
FIG. 7 is a fragmentary sectional view illustrating the worm gear retaining assembly of FIG. 5 in a released condition in which the worm gear can be removed from the frame of the wrench.

The embodiment of the invention illustrated in FIGS. 5 through 7 is generally similar to the embodiment of the invention illustrated in FIGS. 1 through 4. However, in the embodiment of the invention of FIGS. 5 through 7, the worm gear is urged against a sidewall of the gear cavity by one of the retaining pins or plungers. Therefore, a single spring is utilized in the embodiment of the invention illustrated in FIGS. 5 through 7 to perform the functions of the two springs 54 and 58 of the embodiment of the invention illustrated in FIGS. 1 through 4. To avoid prolixity of description, components of the embodiment of FIGS. 5 through 7 which correspond to components of the embodiment of FIGS. 1 through 4 have been designated by similar numerals, the suffix letter *a* will be used in association with the numerals of FIGS. 5 through 7 to avoid confusion.

A worm gear 12*a* (FIG. 5) is rotatably mounted in a gear cavity 20*a* by a releasable retaining assembly 24*a*. The retaining assembly 24*a* includes a pair of coaxial retaining members or pins 32*a* and 34*a*. When the wrench 10*a* is in a fully assembled condition of FIG. 5, the pins 32*a* and 34*a* extend axially outwardly from opposite ends of the worm gear 12*a* into cylindrical cavities 36*a* and 38*a* formed in the frame 22*a* of the wrench 10*a*. Thus, the pin 32*a* includes a cylindrical outer end portion 62*a* which is disposed in the pin cavity 36*a*, a cylindrical main or body portion 70*a* which is disposed in a cylindrical main portion 44*a* of an axially extending bore or cavity 42*a* formed in the worm gear 12*a*. A cylindrical end portion 48*a* of the retaining member 32*a* is disposed in abutting engagement with a cylindrical end portion 100 of the pin 34*a*.

The cylindrical end portion 100 of the pin 34*a* is disposed in a cylindrical portion 102 of the worm gear cavity 42*a*. It should be noted that the cylindrical portion 102 and the cylindrical main portion 44*a* of the worm gear cavity 42*a* are disposed in a coaxial relationship with each other and with the central axis of the worm gear 12*a*. The pin 34*a* also includes a relatively large diameter cylindrical body portion 104 and a somewhat smaller diameter outer end portion 106 which are disposed in a coaxial relationship with the inner end portion 100 of pin 34*a*.

When the wrench 10*a* is to be disassembled, an actuator rod 41*a* is inserted into the cylindrical cavity 36*a* (see FIG. 7) to force the pin member 32*a* entirely into the worm gear cavity 42*a*. As the pin 32*a* is forced into the worm gear cavity 42*a*, the abutting engagement of a circular end surface of the pin 32*a* with a circular end surface of the pin 34*a* causes the pin 34*a* to be forced entirely into the cavity 38*a* against the influence of the biasing spring 54*a*.

Once the pin 32*a* has been forced entirely into the worm gear cavity 42*a* and the pin 34*a* has been forced entirely into the frame cavity 38*a*, the worm gear 12*a* can be removed from the gear cavity 20*a* by merely pressing the worm gear 12*a* sideways in a direction perpendicular to the central axis of the worm gear. Of course, once the worm gear 12*a* has been removed from the gear cavity 20*a*, the movable jaw 14*a* can be easily moved along the guideway 28*a* to fully disassemble the wrench 10*a*.

When the wrench 10*a* is to be reassembled, it is merely necessary to depress the pin 34*a* into the frame cavity 38*a* and to insert the worm gear into the gear cavity 20*a* with the pin 32*a* in the bore 42*a*. When the pins 32*a* and 34*a* are in a coaxial relationship, the biasing spring 54*a* causes the pin 34*a* to move toward the left and extend the cylindrical outer end portion 62*a* of the pin member 32*a* into the pin cavity 36*a*.

As the pin 34*a* moves from the released position shown in FIG. 7 toward the engaged position shown in FIG. 5, an annular shoulder 112 on the body portion 104 of the pin member 34*a* moves into abutting engagement with an end surface 116 of the worm gear 12*a*. Therefore, when the wrench 10*a* is fully assembled, the pin member 34*a* applies an axially directed biasing force to the worm gear 12*a* to press it against the sidewall 66*a* of the gear cavity 20*a*. An annular shoulder 118 on the body portion 70*a* of pin member 32*a* prevents pin member 32*a* from being ejected through cavity 36*a*.

In view of the foregoing description it is apparent that an improved adjustable wrench 10 includes a worm gear 12 which is releasably held in a gear cavity 20 in the frame 22 of the wrench by a retaining assembly 24. The retaining assembly 24 includes a pair of pin or plunger members 32 and 34. During normal use of the wrench 10, the pin members 32 and 34 project outwardly from opposite ends of an axially extending cavity 42 in the worm gear 12 to support the worm gear for rotation about its central axis. When the wrench 10 is to be disassembled, the pin member 32 is pressed completely into the cavity 42 in the worm gear and the other pin member 34 is pressed completely into a cavity 38 in the frame 22 of the wrench. The worm gear 12 can then be moved sidewardly out of the gear cavity 20. When the wrench 10 is to be reassembled, the pin 32 is telescoped back into the cavity 42 in the worm gear while the other pin 34 is pessed into the cavity 38 in the frame 22 of the wrench. The worm gear 12 is then inserted into the gear cavity 20 and the pins are released.

Having described specific preferred embodiments of the invention, the following is claimed:

1. A wrench comprising a frame having major and minor side surfaces, a fixed jaw connected with said frame, a movable jaw slidably mounted on said frame for movement toward and away from said fixed jaw, a rack gear connected with said movable jaw, said frame including first surface means for at least partially defining a gear cavity in said frame adjacent to said rack gear, said gear cavity having at least one opening in the major side surface of said frame, said frame further including second surface means for at least partially defining a second cavity in said frame and opening into said gear cavity and third surface means for defining a third cavity in said frame and opening into said gear cavity, a worm gear disposed in said gear cavity in meshing engagement with said rack gear, said worm gear including surface means for at least partially defining a cavity in said worm gear, said cavity in said worm gear having a central axis coincident with a central axis of said worm gear, retaining means for releasably retaining said worm gear in said gear cavity in said frame, for enabling said worm gear to be rotated about its central axis to effect movement of said movable jaw relative to said fixed jaw and for enabling said worm gear to be removed from said gear cavity through the opening in the major side surface of said frame to facilitate disassembly of said wrench, said retaining means including a first member movable from an engaged position extending outwardly from said cavity in said worm gear into said second cavity in said frame to a second position in which said first member is disposed substantially entirely within said cavity in said worm gear to at least partially release said worm gear for movement through said opening in said major side surface of said frame in a direction transverse to the central axis of said worm gear and a second member extending outwardly from said cavity in said worm gear into said third cavity in said frame, said first and second members being cooperable with said frame and said worm gear to support said worm gear for rotation about its central axis, and spring means disposed in said third cavity in said frame for resiliently urging said second member toward said worm gear, said first member being movable in said cavity in said worm gear to move said second member against the influence of said spring means.

2. A wrench comprising a frame having major and minor side surfaces, a fixed jaw connected with said frame, a movable jaw slidably mounted on said frame for movement toward and away from said fixed jaw, a rack gear connected with said movable jaw, said frame including first surface means for at least partially defining a gear cavity in said frame adjacent to said rack gear, said gear cavity having at least one opening in the major side surface of said frame, said frame further including second surface means for at least partially defining a second cavity in said frame and opening into said gear cavity and third surface means for defining a third cavity in said frame and opening into said gear cavity, a worm gear disposed in said gear cavity in meshing engagement with said rack gear, said worm gear including surface means for at least partially defining a cavity in said worm gear, said cavity in said worm gear having a central axis coincident with a central axis of said worm gear, and retaining means for releasably retaining said worm gear in said gear cavity in said frame, for enabling said worm gear to be rotated about its central axis to effect movement of said movable jaw relative to said fixed jaw and for enabling said worm gear to be removed from said gear cavity through the opening in the major side surface of said frame to facilitate disassembly of said wrench, said retaining means including a first member movable from an engaged position extending outwardly from said cavity in said worm gear into said second cavity in said frame to a second position in which said first member is disposed substantially entirely within said cavity in said worm gear to at least partially release said worm gear for movement through said opening in said major side surface of said frame in a direction transverse to the central axis of said worm gear and a second member extending outwardly from said cavity in said worm gear into said third cavity in said frame, said first and second members being cooperable with said frame and said worm gear to support said worm gear for rotation about its central axis, said first member including surface means for applying force to said second member to effect movement of said second member from said cavity in said worm gear into said third cavity in said frame upon movement of said first member from said engaged position to said second position.

3. A wrench comprising a frame at least partially defining a gear cavity, a fixed jaw connected with said frame, a movable jaw connected with said frame for movement toward and away from said fixed jaw, and means for moving said movable jaw relative to said fixed jaw, said means for moving said movable jaw including a worm gear having an internal cavity with openings at opposite end portions of said worm gear, and retaining means for releasably retaining said worm gear in said gear cavity, said retaining means including first and second members movable between a first condition in which each of said members extends outwardly from an associated one of the end portions of said worm gear into engagement with said frame to hold said worm gear in said gear cavity and a second condition in which said first member is disposed substantially entirely within said cavity in said worm gear and said second member is disposed substantially entirely outside of said cavity in said worm gear to release worm gear for movement from said gear cavity, said first member including surface means for engaging said second member and applying a force to said second member to move said second member from said first condition to said second condition upon movement of said first member from said first condition to said second condition.

4. A wrench as set forth in claim 3 further including spring means for urging said first member toward said first condition, said frame including passage means for enabling a force to be applied to an end portion of said first member opposite from said surface means to effect movement of said first member from said first condition to said second condition against the influence of said spring means.

5. A wrench as set forth in claim 3 further including first spring means disposed in said cavity in said worm gear for urging said first member toward said first condition and second spring means spaced apart from said first spring means for urging said second member toward said first condition.

6. A wrench as set forth in claim 3 wherein said worm gear includes surface means for defining a shoulder within said cavity in said worm gear, said first member having a body portion which is spaced apart from said shoulder when said first member is in said first condition and is disposed in abutting engagement with said shoulder when said first member is in said second condition.

7. A wrench as set forth in claim 3 wherein said frame means includes surface means for at least partially defining first and second frame cavities on opposite sides of said gear cavity, said first member having a first end portion which is disposed within said first frame cavity when said first member is in said first condition and a second end portion which is disposed within said cavity in said worm gear when said first member is in said first condition, said first member surface means being disposed on said second end portion of said first member, said second member having a first end portion which is disposed within said cavity in said worm gear when said second member is in said first condition and which is disposed in abutting engagement with said first member surface means when said second member is in said second condition, said second member having a second end portion which is disposed within said second frame cavity when said second member is in said first and second conditions.

8. A wrench as set forth in claim 7 further including first spring means within said cavity in said worm gear for urging said first member toward said first condition, and second spring means disposed within said second frame cavity for urging said second member toward said first condition, said first and second members being movable from said first condition to said second condition against the combined influence of said first and second spring means.

9. A wrench as set forth in claim 7 further including spring means in said second frame cavity for urging said first and second members toward said first condition, said first and second members being movable from said first condition toward said second condition against the influence of said spring means.

10. A wrench comprising a frame having major and minor side surfaces, a fixed jaw connected with said frame, a movable jaw slidably mounted on said frame for movement toward and away from said fixed jaw, a rack gear connected with said movable jaw, said frame including first surface means for at least partially defining a gear cavity in said frame adjacent to said rack gear, said gear cavity having at least one opening in the major side surface of said frame, said frame further including second surface means for at least partially defining a first frame cavity and third surface means for defining a second frame cavity, said first and second frame cavities opening into opposite sides of said gear cavity, a worm gear disposed in said gear cavity in meshing engagement with said rack gear, said worm gear including surface means for at least partially defining a cavity in said worm gear, said cavity in said worm gear having a central axis coincident with a central axis of said worm gear and with central axes of said frame cavities, and retaining means for releasably retaining said worm gear in said gear cavity in said frame, for enabling said worm gear to be rotated about its central axis to effect movement of said movable jaw relative to said fixed jaw and for enabling said worm gear to be removed from said gear cavity through the opening in the major side surface of said frame to facilitate disassembly of said wrench, said retaining means including a first member movable along the central axis of said cavity in said worm gear from an engaged position extending outwardly from said cavity in said worm gear into said first frame cavity to a disengaged position in which said first member is disposed substantially entirely within said cavity in said worm gear, a second member movable along the central axis of said cavity in said worm gear from an engaged position extending outwardly from said cavity in said worm gear into said second frame cavity to a disengaged position in which said second member is disposed substantially entirely within said second frame cavity, said worm gear being rotatably held in said gear cavity by said first and second members when said first and second members are in their engaged positions and being at least partially released formovementthroughsaid opening in said major side surface of said frame in a direction transverse to the central axis of said worm gear when said first and second members are in their disengaged positions, and spring means disposed in one of said frame cavities for urging said first and second members toward their engaged positions.

11. A wrench as set forth in claim 10 further including second spring means in said cavity in said worm gear for urging said first member toward its engaged position.

12. A wrench as set forth in claim 10 wherein said first member includes surface means for applying force to said second member to effect movement of said second member from said cavity in said worm gear into said second frame cavity upon movement of said first member from its engaged position to its disengaged position.

13. A wrench comprising a frame having major and minor side surfaces, a fixed jaw connected with said frame, a movable jaw slidably mounted on said frame for movement toward and away from said fixed jaw, a rack gear connected with said movable jaw, said frame including a gear cavity having opposite side walls, a first pin cavity opening into said gear cavity through one side wall of said gear cavity and a second pin cavity opening into said gear cavity through another side wall of said gear cavity, a worm gear disposed in said gear cavity in meshing engagement with said rack gear, said worm gear having a first axial end portion disposed adjacent to said one side wall of said gear cavity and a second axial end portion disposed adjacent to the other side wall of said gear cavity, said worm gear including internal surface means defining a cavity which extends through said worm gear, said worm gear cavity having a first opening in said first axial end portion of said worm gear and a second opening in said second axial end portion of said worm gear, first and second pin members, said first and second pin members being movable between retaining positions in which said first and second pin members are effective to retain said worm gear in said gear cavity and release positions in which said first and second pin members are ineffective to retain said worm gear in said gear cavity, said first pin member extending through said first opening in said worm gear and having a first end portion disposed in said worm gear cavity and a second end portion disposed in said first pin cavity when said first pin member is in its retaining position, said second pin member extending through said second opening in said worm gear and having a first end portion disposed in said worm gear cavity in abutting engagement with said first end portion of said first pin member and having a second end portion disposed in said second pin cavity when said second pin member is in its retaining position, said first pin member being disposed substantially entirely in said worm gear cavity when said first pin member is in its release position, said second pin member being disposed substantially entirely in said second pin cavity when said second pin member is in its release position, said first end portion of said first pin member being effective to apply a force against said first end portion of said second pin member to move said second pin member out of said worm gear cavity and further into said second pin cavity upon movement of said first pin member from its retaining position to its release position.

14. A wrench as set forth in claim 13 further including spring means in said second pin cavity for pressing said second pin member against said first pin member when said pin members are in their retaining positions.

15. A wrench comprising a frame having major and minor side surfaces, a fixed jaw connected with said frame, a movable jaw slidably mounted on said frame for movement toward and away from said fixed jaw, a rack gear connected with said movable jaw, said frame including a gear cavity having opposite side walls, a first cavity opening into said gear cavity through one side wall of said gear cavity and a second cavity opening into said gear cavity through another side wall of said gear cavity, a worm gear disposed in said gear cavity in meshing engagement with said rack gear, said worm gear having a first axial end portion disposed adjacent to said one side wall of said gear cavity and a second axial end portion disposed adjacent to the other side wall of said gear cavity, said worm gear including internal surface means for defining a continuous cavity extending axially through said worm gear, said worm gear cavity having a first opening in said first axial end portion of said worm gear and a second opening in said second axial end portion of said worm gear, first and second members, said first and second members being slidable axially along said internal surface means of said worm gear between retaining positions in which said first and second members are effective to retain said worm gear in said gear cavity and release positions in which said first and second members are ineffective to retain said worm gear in said gear cavity, said first member extending through said first opening in said worm gear and having a first portion disposed in said worm gear cavity and a second portion disposed in said first cavity when said first member is in its retaining position, said first member being disposed substantially entirely in said worm gear cavity when said first member is in its release position, said second member extending through said second opening in said worm gear and having a first portion disposed in said worm gear cavity and a second portion disposed in said second cavity when said second member is in its retaining positions, said first cavity including surface means defining an opening in an outer surface of said frame for enabling an actuator member to be inserted through said opening in the outer surface of said frame into engagement with said first member to apply a force against said first member and effect movement of said first member from its retaining position to its release position, and spring means for urging said first and second members toward their retaining positions, said first member being movable from its retaining position against the urging of said spring means under the influence of the force applied to said first member by the actuator member, said second member being disposed substantially entirely in said second cavity when said second member is in its release position.

16. A wrench comprising a frame having major and minor side surfaces, a fixed jaw connected with said frame, a movable jaw slidably mounted on said frame for movement toward and away from said fixed jaw, a rack gear connected with said movable jaw, said frame including a gear cavity having opposite side walls, a first cavity opening into said gear cavity through one side wall of said gear cavity and a second cavity opening into said gear cavity through another side wall of said gear cavity, a worm gear disposed in said gear cavity in meshing engagement with said rack gear, said worm gear having a first axial end portion disposed adjacent to said one side wall of said gear cavity and a second axial end portion disposed adjacent to the other side wall of said gear cavity, said worm gear including internal surface means for defining a continuous cavity extending axially through said worm gear, said worm gear cavity having a first opening in said first axial end portion of said worm gear and a second opening in said second axial end portion of said worm gear, first and second members, said first and second members being slidable axially along said internal surface means of said worm gear between retaining positions in which said first and second members are effective to retain said worm gear in said gear cavity and release positions in which said first and second members are ineffective to retain said worm gear in said gear cavity, said first member extending through said first opening in said worm gear and having a first portion disposed in said worm gear cavity and a second portion disposed in said first cavity when said first member is in its retaining position, said first member being disposed substantially entirely in said worm gear cavity when said first member is in its release position, said second member extending through said second opening in said worm gear and having a first portion disposed in said worm gear cavity and a second portion disposed in said second cavity when said second member is in its retaining position, said first cavity including surface means defining an opening in an outer surface of said frame for enabling an actuator member to be inserted through said opening in the outer surface of said frame into engagement with said first member to apply a force against said first member and effect movement of said first member from its retaining position to its release position, and spring means for urging said first and second members toward their retaining positions, said first member being movable from its retaining position against the urging of said spring means under the influence of the force applied to said first member by the actuator member, said first and second members having end surfaces which are disposed in abutting engagement when said first and second members are in their release positions.

* * * * *